US006036628A

United States Patent [19]

Romer

[11] Patent Number: 6,036,628

[45] Date of Patent: Mar. 14, 2000

[54] PILLOW BOX MAKER APPARATUS AND METHOD OF USE

[76] Inventor: Nicholas K. Romer, 806 Morris Turnpike, #3P6, Short Hills, N.J. 07078

[21] Appl. No.: 09/188,427

[22] Filed: Nov. 9, 1998

[51] Int. Cl.[7] ..... B31B 01/14

[52] U.S. Cl. ..... 493/57; 493/59; 493/63; 493/468

[58] Field of Search ..... 493/51, 52, 57, 493/63, 86, 59, 160, 373, 83, 354, 355, 468, 901, 902

[56] References Cited

U.S. PATENT DOCUMENTS

| | | | |
|---|---|---|---|
| 1,999,314 | 4/1935 | Anderson | 493/355 |
| 3,000,237 | 9/1961 | Phillips et al. | 493/59 |
| 3,929,059 | 12/1975 | Gendron | 93/58.3 |
| 4,177,715 | 12/1979 | Meyers | 493/59 |
| 4,544,367 | 10/1985 | Vossen | 493/355 |
| 4,615,804 | 10/1986 | Wright | 493/404 |
| 4,637,811 | 1/1987 | Fortney | 493/902 |
| 4,850,950 | 7/1989 | Holliday | 493/59 |
| 5,021,042 | 6/1991 | Resnick et al. | 493/59 |
| 5,035,684 | 7/1991 | Sorrells | 493/373 |
| 5,156,584 | 10/1992 | Cohen et al. | 493/59 |
| 5,178,600 | 1/1993 | Harder | 493/162 |
| 5,211,084 | 5/1993 | Holliday et al. | 493/354 |
| 5,333,519 | 8/1994 | Holliday et al. | 493/354 |
| 5,484,373 | 1/1996 | Carbone | 493/59 |
| 5,496,250 | 3/1996 | Fielder | 493/373 |
| 5,599,267 | 2/1997 | Dupuy | 493/59 |
| 5,893,825 | 4/1999 | Rebeaud | 493/373 |

*Primary Examiner*—Eugene L. Kim
*Attorney, Agent, or Firm*—Henderson & Sturm LLP

[57] ABSTRACT

A pillow box making apparatus 10 and method of use wherein the box making apparatus 10 includes a base panel member 20 provided with a guide element 21, a cushioned pad member 30 dimensioned to overlie a portion of the base panel member 20, a template member 40 operatively associated with the base plate member 20 to captively engage a sheet of craft paper 20 intermediate the cushioned pad member 30 and the template member 40. The template member 40 is provided with at least one generally elongated figure eight shaped apertures 50 and a plurality of slots 61, 62, 63, and 64 that can be used to define the scored outline of the unassembled pillow box 100.

12 Claims, 4 Drawing Sheets

PILLOW BOX MAKER APPARATUS AND METHOD OF USE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of box making devices in general, and in particular to a box making apparatus specifically designed to make pillow shaped boxes.

2. Description of Related Art

As can be seen by reference to the following U.S. Pat. Nos. 3,929,009; 5,156,584; 5,178,600; and 5,484,373, the prior art is replete with myriad and diverse rectangular shaped box making apparatus.

While all of the aforementioned prior art constructions are more than adequate for the basic purpose and function for which they have been specifically designed, they are uniformly deficient with respect to their failure to provide a simple, efficient, and practical method and apparatus for fabricating different sized pillow shaped boxes having any desired length.

As most home crafters are all too well aware, they have a wide variety of rectangular shaped box making devices from which to choose to construct the ubiquitous plain rectangular box.

As a consequence of the foregoing situation, there has existed a longstanding need for a new and improved type of box making apparatus and method of use for fabricating a non-rectangular shaped box such as a pillow box or the like, and the provision of such a method and apparatus is a stated objective of the present invention, and the provision of such a construction is a stated objective of the present invention.

BRIEF SUMMARY OF THE INVENTION

Briefly stated, the pillow box making apparatus that forms the basis of the present invention comprises in general a base unit, a cushion unit, and a template unit.

The base unit serves as a support for the cushion unit and cooperates with the template unit to captively engage a sheet of craft paper between the cushion unit and the template unit.

As will be explained in greater detail further on in the specification, once the sheet of craft paper is captively engaged in the box making apparatus, a stylus member is employed to score the top surface of the craft paper in accordance with a series of slots formed in the template unit.

Once the craft paper or card stock has been scored in accordance with the proscribed pattern of the template unit, the craft paper is removed from the apparatus and subjected to severing, folding, and gluing steps to produce the pillow shaped finished box.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
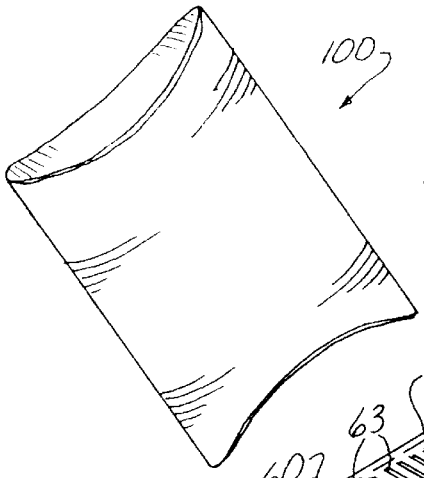
FIG. 1 is a perspective view of the finished pillow box fabricated from the method that is to be employed with the pillow box making apparatus that forms the basis of the present invention.
Figure 2:
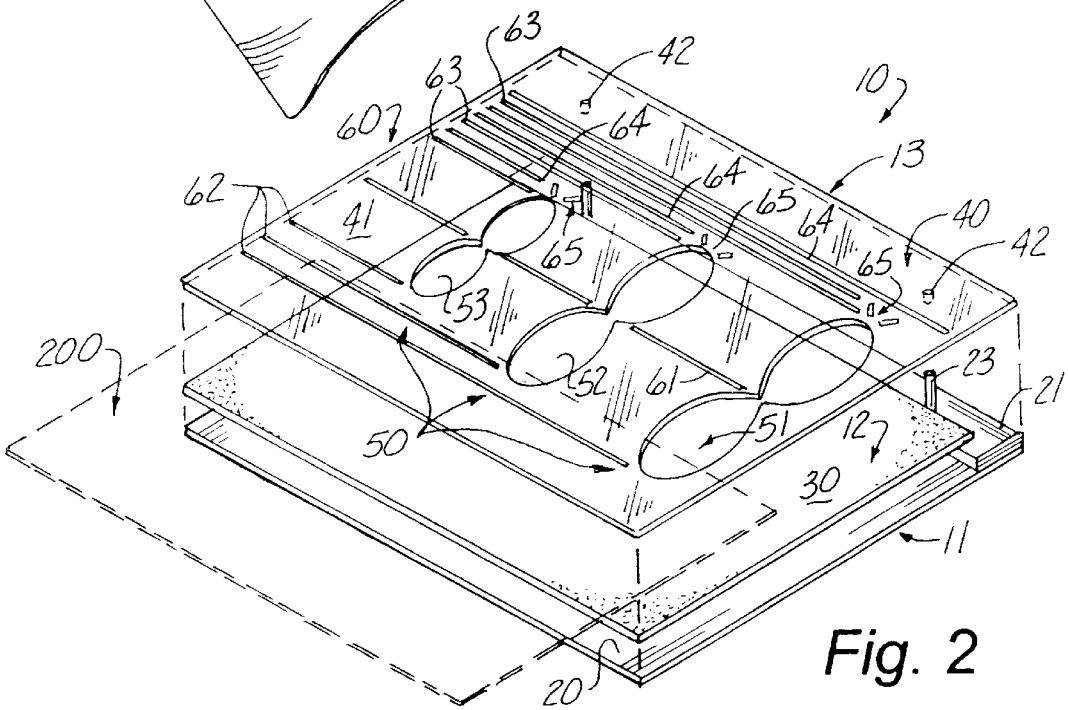
FIG. 2 is a perspective view of the pillow box making apparatus.

As can be seen by reference to the drawings, and in particularly to FIG. 2, the pillow box making apparatus that forms the basis of the present invention is designated generally by the reference number 10. The apparatus 10 comprises in general, a base unit 11, a cushion unit 12, and a template unit 13 which cooperates with a stylus unit 14 to produce a pillow shaped box member 100 from a sheet 200 of craft paper. These units will now be described in seriatim fashion.

Figure 3:
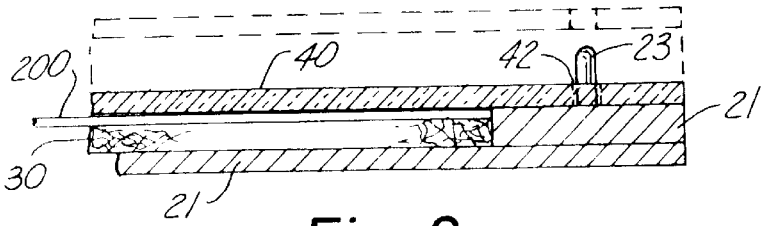
FIG. 3 is a cross sectional detail view of one end of the pillow box making apparatus.

As shown in FIGS. 2 and 3, the base unit 11 comprises a generally flat rectangular base panel member 20 provided with a relatively narrow rectangular guide element 21 which is disposed along one edge of the base panel member 20 wherein the upper surface of the guide element 21 is provided with a plurality of vertically projecting post elements 23 whose purpose and function will be described further on in the specification.

As can also be seen by reference to FIGS. 2 and 3, the cushion unit 12 comprises a generally rectangular cushioned pad member 30 dimensioned to overlie that portion of the base panel member 20 that is not occupied by the guide element 21. The thickness of the pad member 30 is slightly less than the height of the stop element 21.

As can best be seen by reference to FIG. 3, the uncompressed height or thickness of the cushioned pad member 30 is less than the height of the guide element 21 so that the top surface of the sheet of craft paper 200 is aligned in a generally flush fashion relative to the top surface of the guide element 21 for reasons that will be explained presently.

Figure 4:
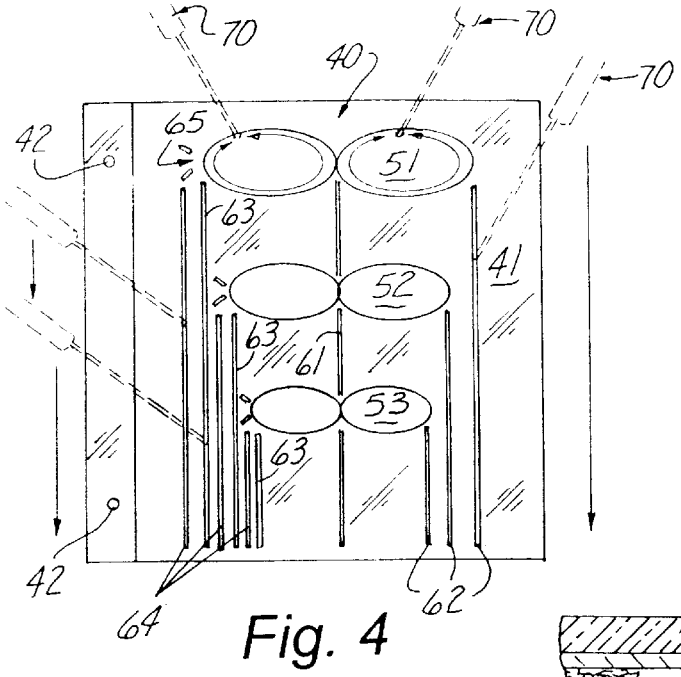
FIG. 4 is a top plan view of the apparatus.
Figure 5:
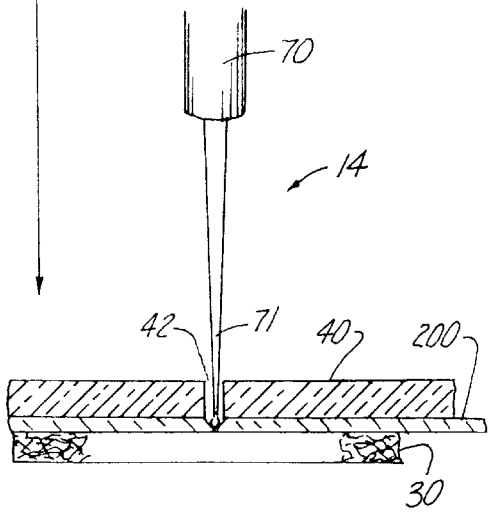
FIG. 5 is an isolated detail view of the cooperation between the template unit, the cushion unit, the stylus unit, and a sheet of craft paper.

Turning now to FIGS. 2 through 4, it can be seen that the template unit 13 comprises a generally flat rectangular template member 40 fabricated from a sheet of generally clear plastic material 41 which is dimensioned to overlie both the base panel member 20 and the stop element 21.

In addition, one side of the template member 40 is provided with a plurality of discrete apertures 42 which are dimensioned to receive the post elements 23 on top of the stop element 21 so that the template member 40 can be fixedly secured relative to the base unit 11 and on top of the sheet of craft paper 200 to releasably engage the sheet of craft paper 200 intermediate the template member 40 and the cushioned pad member 30.

As can be seen by reference to FIGS. 2 and 4, the template member 40 is provided with a plurality of apertures designated generally as 50 and a plurality of slots designated generally as 60 which are aligned both parallel to one another and in accordance with a specific relationship to the respective plurality of apertures as will be explained presently.

As can also be seen by reference to FIGS. 2 and 4, the apertures 50 comprise a plurality of diminishing size elongated figure eight shaped apertures 51, 52, 53 wherein the longitudinal axis of the apertures 51, 52 and 53 are aligned parallel to one another and wherein the narrow waist portion of the elongated apertures 51, 52, and 53 are likewise laterally aligned relative to one another.

Still referring to FIGS. 2 and 4, it can be seen that the elongated apertures 51, 52, and 53 all share a single discontinuous centerline slot 61 having segments which intersect the narrow waist portion of each individual aperture 51, 52, 53. Furthermore, each of the apertures 51, 52, 53 are also provided with groups of three distinct slots 62, 63, and 64 wherein the first slot 62 defines one edge 101 of the assembled pillow box 100, the second slot 63 defines the other edge 102 of the assembled pillow box 100, and the third slot 64 defines the locking tab 103 which joins the opposed edges 101, 102 of the assembled pillow box 100 as will be explained presently.

In addition, one end of each of the apertures 51, 52, 53 are provided with a pair of discrete converging angle slots 65 which are intended to facilitate the severing of the outline of the unassembled pillow box 100 as will also be explained further on in the specification.

Prior to embarking on a description of the method that is employed to fabricate the finished pillow boxes 100, it should first be noted that while the elongated figure eight shaped apertures 51, 52, and 53 are each shown as single elongated apertures each of these apertures 51, 52, 53 could also comprise two closely spaced oval apertures (not shown) disposed adjacent to a continuous centerline slot 61 (likewise not shown).

The various steps employed in the manufacture/assembly of the pillow boxes are depicted in sequential fashion in FIGS. 2 through 12. The initial scoring steps employed in the fabrication of the pillow boxes are depicted in FIGS. 2 through 5, and involve placing a sheet of craft paper 200 on top of the cushioned pad member 30 and abutting one edge of the craft paper 200 against the edge of the guide element 21.

At this point, the apertures 42 in the template member 40 are registered with the post elements 23 on the guide element 21 to captively engage the craft paper 200 between the cushioned pad member 30 and the template member 40. Then once the craft paper 200 is properly positioned, the stylus unit 14 is employed to produce score lines on the upper surface of the craft paper by inserting the pointed end 71 of the stylus member 70 into the slots 60 and around the periphery of the apertures 50 in a well recognized manner.

At this juncture it should be noted that each of the individual apertures 51, 52, 53, as well as their associated slots 61, 62, 63, and 64, only define the upper portion of different width pillow boxes. Therefore, in order to complete the scoring of the complete outline of the unfinished pillow box, it will be necessary to either rotate the craft paper 200 180° to complete the lower portion of the different width pillow boxes or to simply slide the craft paper 100 further along the guide element 21.

It should further be noted that the length of the pillow boxes can be extended to multiple lengths of the template member 40 by employing an oversize sheet of craft paper 200 with the box making apparatus 10 of this invention.

Figure 6:
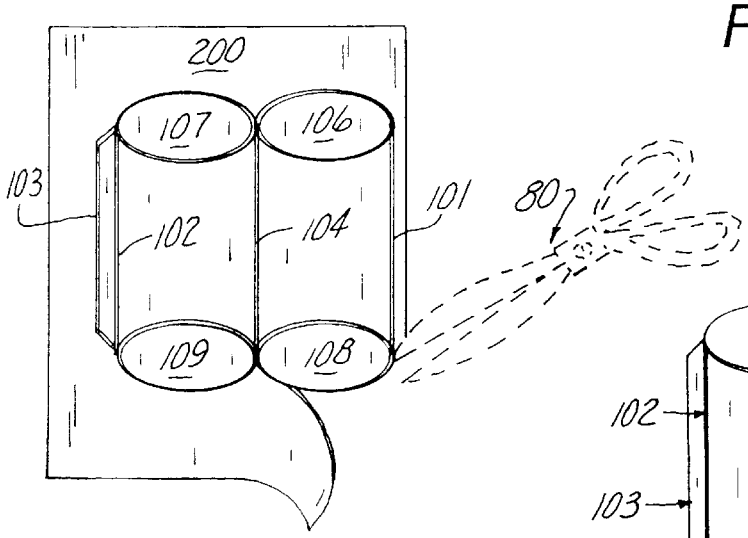
FIG. 6 illustrates the step of severing the craft paper.
Figure 7:
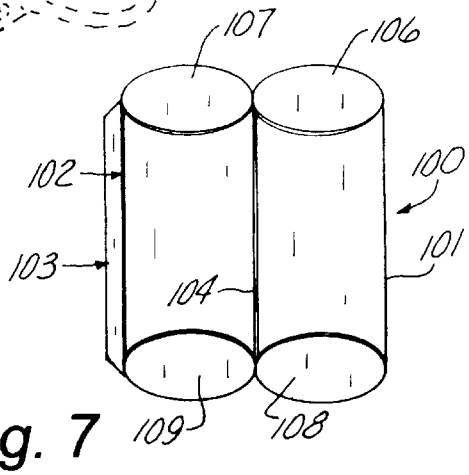
FIG. 7 is a top plan view of the unassembled pillow box.
Figure 8:
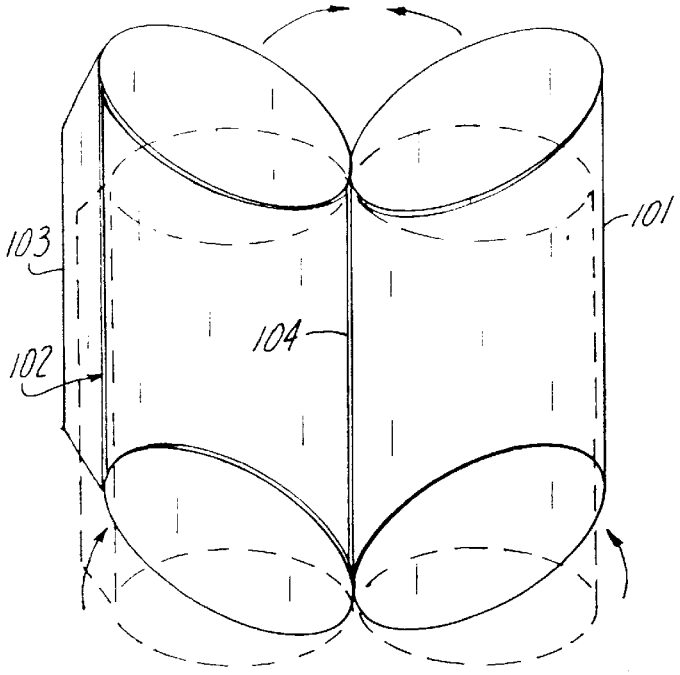
FIG. 8 depicts the initial folding step employed in the method of fabricating the pillow box.
Figure 9:
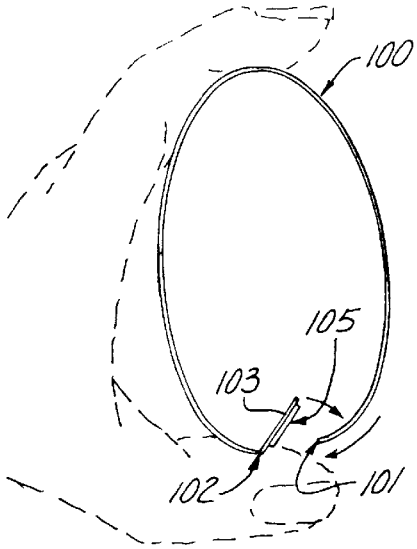
FIG. 9 depicts the adhesive joining of the two dies of the pillow box.
Figure 10:
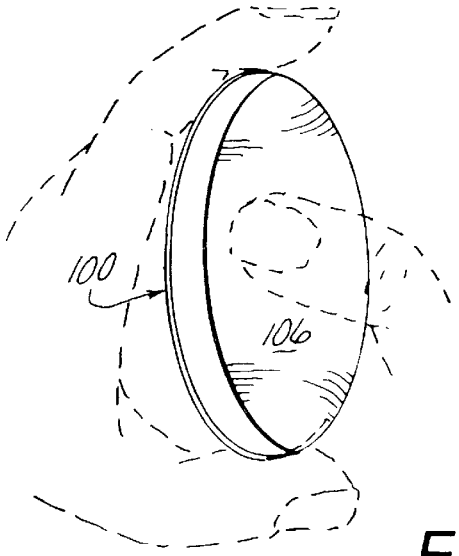
FIG. 10 depicts the folding of one side of one of the end closures.
Figure 11:
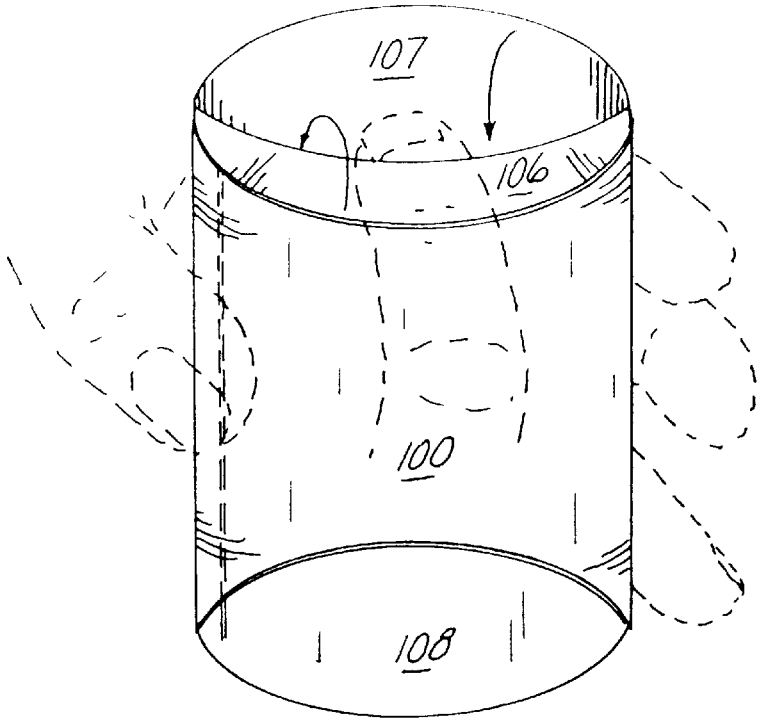
FIG. 11 depicts the folding of the second side of one of the end closures.
Figure 12:
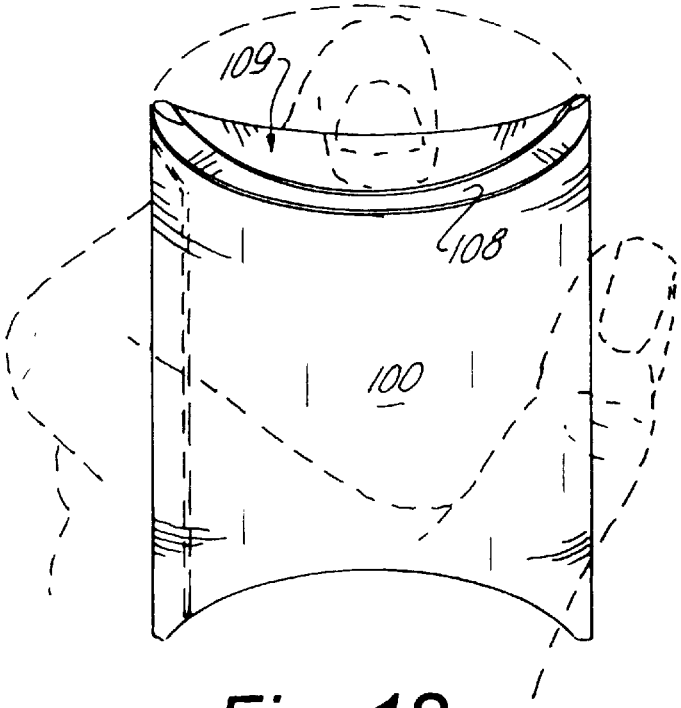
FIG. 12 depicts the final step in the fabrication of the finished pillow box.

The severing step is illustrated in FIG. 6 wherein the craft paper 200 is trimmed by a severing implement 80 such as a pair of scissors or the like (shown in phantom) to produce the outline of the unassembled pillow box 100 as depicted in FIG. 7.

The folding and joining steps are depicted in FIGS. 8 through 12 and involve folding the unassembled pillow box outline about the centerline score 104 to bring the opposite finished edges 101, 102 of the pillow box 100 into contact with one another. The sealing flap 103 is disposed on the interior surface of the box 100 and adhesively joined such as at 105 to the interior surface of the box 100 adjacent of the edge 101.

At this juncture, one of the upper end flaps 106 is folded inwardly followed by the overlapping folding action of the other upper end flap 107 to close the upper end of the pillow box 100. Then one of the bottom end flaps 108 is folded inwardly and the other bottom end flap 109 is overlapped thereon to complete the assembly of the finished pillow box 100.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A box making apparatus for making a pillow shaped box from a sheet of craft paper; wherein the box making apparatus comprises:

a base unit including a generally rectangular base panel member having one edge provided with a narrow rectangular guide element;

a template unit including a generally rectangular template member provided with at least one elongated generally curved aperture and a plurality of slots aligned with said at least one aperture;

means for captively engaging said sheet of craft paper intermediate the base panel member and the template member; and a stylus unit including a stylus member having a pointed end which is dimensioned to be received in said plurality of slots and around the internal periphery of said at least one aperture to impress a score line pattern in the upper surface of said sheet of craft paper.

2. The box making apparatus as in claim 1 further including a plurality of apertures wherein said plurality of apertures comprise at least one pair of oval apertures aligned in a generally elongated figure eight configuration.

3. The box making apparatus as in claim 2 wherein said plurality of slots are aligned parallel to one another and disposed perpendicular to the longitudinal axis of said plurality of apertures.

4. The box making apparatus as in claim 3 wherein said at least one pair of oval apertures are provided with a centerline slot disposed intermediate said pair of apertures and wherein each of the pair of apertures are also provided with a box edge slot disposed adjacent to their respective outboard ends.

5. The box making apparatus as in claim 4 wherein the outboard end of at least one of the pair of oval apertures is further provided with a locking tab slot which is aligned adjacent to, but spaced outwardly from, the associated box edge slot.

6. The box making apparatus as in claim 1 wherein said at least one aperture comprises a single generally elongated figure eight shaped aperture having an intermediate waist portion and two outboard ends; and said plurality of slots comprise a centerline slot aligned with said intermediate portion and a pair of box edge slots aligned with said two outboard ends.

7. The box making apparatus as in claim 6 wherein said plurality of slots are aligned parallel to one another and perpendicular to the longitudinal axis of said at least one aperture.

8. The box making apparatus as in claim 7 wherein said plurality of slots further includes: a locking tab slot which is aligned adjacent to, but spaced outwardly from one of the box edge slots.

9. The box making apparatus as in claim 1 further comprising a plurality of apertures wherein each of said apertures comprises a different sized generally elongated figure eight shaped aperture.

10. The box making apparatus as in claim 9 wherein each of the apertures are provided with a group of slots which include a centerline slot aligned with the intermediate portion of the respective figure eight shaped aperture; and a pair of box edge slots aligned with the opposite ends of the aperture.

11. The box making apparatus as in claim 10 wherein said group of slots further includes: a locking tab slot which is aligned adjacent to, but outwardly spaced from one of said box edge slots.

12. The box making apparatus as in claim 1 wherein said means for captively engaging said sheet of craft paper includes a cushioned pad member disposed intermediate the base panel member and the sheet of craft paper.

* * * * *